United States Patent [19]

Cross

[11] 4,285,683

[45] Aug. 25, 1981

[54] METHOD OF MAKING A DISPLAY MOUNT

[76] Inventor: Carroll N. Cross, Rte. 2, Box 741, Maitland, Fla. 32751

[21] Appl. No.: 116,158

[22] Filed: Jan. 28, 1980

Related U.S. Application Data

[63] Continuation-in-part of Ser. No. 870,745, Jan. 19, 1978, Pat. No. 4,199,883.

[51] Int. Cl.[3] ..... G09F 1/10

[52] U.S. Cl. ..... 493/325; 40/159; 248/459; 493/342; 493/349; 493/944

[58] Field of Search ..... 93/1 R, 1 G, 35 PC; 248/459; 40/159, 124.2, 124.4, 155, 158 R

[56] References Cited

U.S. PATENT DOCUMENTS

| | | | |
|---|---|---|---|
| 2,831,285 | 4/1958 | Cross | 248/459 X |
| 2,875,672 | 3/1959 | Cross | 93/1 R |
| 3,058,401 | 10/1962 | Cross | 93/1 G |
| 3,067,652 | 12/1962 | Cross | 93/1 R |
| 3,068,139 | 12/1962 | Cross | 156/213 |
| 3,079,715 | 3/1963 | Cross | 40/159 |
| 3,275,280 | 9/1966 | Nichols | 93/1 R X |

*Primary Examiner*—James F. Coan

*Attorney, Agent, or Firm*—Duckworth, Hobby & Allen

[57] ABSTRACT

A method of making a display mount for holding calendars, photographs, and the like, is provided with a rectangular backing panel, an intermediate spacing panel mounted adjacent thereto, and a partial face panel mount in the front of the intermediate panel. The panels have been case bound with a facing material and die cut to form one or more mounting wells therein. The pockets for the mounting well use only a partial face panel allowing for easy removal of the die cut portions, and the reduction of the weight of the display mount. The method includes cutting a single piece of planar material and scoring parallel lines for folding into three panels. Incisions are then cut into the intermediate panel for the display mount, so that when the boards are folded parallel and case bound, the mounting well can be die cut, cutting a section from the partial face board, and a partial section from the intermediate panel co-acting with the already cut portion in the intermediate panel and the cut portions can be removed to form the well and pockets.

5 Claims, 6 Drawing Figures

METHOD OF MAKING A DISPLAY MOUNT

This is a continuation-in-part of application Ser. No. 870,745, filed Jan. 19, 1978, now U.S. Pat. No. 4,199,883.

BACKGROUND OF THE INVENTION

The present invention relates to display mounts and to the method of making display mounts, and especially to display mounts utilizing a partial face plate, and the method of making the display mounts with formed pockets therein for holding calendars, or the like.

In the past, mounts for the display of calendars or other inserts have generally been made of a plurality of superimposed boards. One common mount uses one or more pieces of cardboard, which has attached to it a plurality of calendar leaves by means of staples or stitches. This type of mount is inexpensive in construction, but embodies the disadvantage of exposed leaf corners, which invariably tend to curl and become unsightly after a short period of time. Another kind of mount has been of more substantial construction, providing a well in which the calendar leaves were supported with their margins in contact with the overlapping rear margin of the window element attached to the well member. This type of mount requires a flap closed passage in the back for the insertion of the matter to be displayed therein, and results in a construction which prevent the leaf edge and corners from curling but has been obtained at a high cost.

In my prior U.S. Pat. No. 2,355,706, I disclose a display mount having a well in the face thereof for displaying materials such as calendar pads. The patent provides corner or edge restraints which cooperate with displayed materials therein to hold such material against warping or curling. The structure has been successful for its intended purpose, but it has not permitted insertion and removal of the display material as easily and as rapidly as might be desired. This has been true particularly when removal and re-insertion of display material is undertaken by the ultimate user, such as might be required when the display material consists of a pad of month-to-month calendar sheets.

In my prior U.S. Pat. Nos. 3,058,401 and 3,079,715, I have provided an improved display mount structure and improved method for forming the display windows and display wells and display mount structures, and particularly for the formation of such wells having display material edge and corner restraints. In these patents, several panel edges are case bound together with a binding material which is adhesively attached to the exposed faces of the superimposed mounting panels and wrapped about the edges thereof to hold an assembly of mount panels together. The panels, in this prior patent, are folded in face-to-face relationship with each other, such that the intermediate board lies between the face board and the back board. When so folded, the boards are secured to each other by attaching a facial covering of bonding material which extends about the edges of the assembled panels. The display window cutting operation is performed along incisions, which throughout the major portion of the perimeter of the window correspond to the outline of the material to be displayed, and along incisions at spaced points along the perimeter which are inset to form overlay display material restraints. These inset incisions extend in the direction of the free edge of the intermediate board, but terminate short thereof, such that a gap is formed between such free edge of the intermediate board and the overlaying restraints through which display material is inserted.

In addition to these patents, I have also obtained other patents on display and photo mounts, typical of which may be seen in U.S. Pat. Nos. 3,216,582, 3,068,139, and 3,002,720, and including my aluminum hinge patent, which allows a supporting prop or other display mount support to be mounted with a flexible hinged panel which stays in place without the use of interconnecting tongues or the like. The present invention is an improvement to my prior patents, and especially to the aforementioned U.S. Patents, in which a three layered display mount which is case bound has a spacing or intermediate panel or board to form the pocket in the mount, but utilizes a partial facing panel, thereby reducing the weight of the mount. The present display mount has a pocket that allows an easy grasp of a pad of leaves of a calendar for changing the month by the user, along with a reduced tendency of warping, and increased strength by the use of three case bound panels bound together. In addition, the insertion of the calendar pad is made easier, and certain advantages, such as the printing of ad copy on one level of the mount when certain types of mounts are being made, while providing three dimensional artistic effect with different planes of ad panels.

SUMMARY OF THE INVENTION

A display mount and method of making a display mount are provided in which a generally rectangular back panel is mounted adjacent to an intermediate spacer panel of substantially the same size as the back panel and a face panel having an area substantially smaller than the back and intermediate panels is mounted adjacent the intermediate and back panels. A flexible binding is case bound over the panels and about the edges thereof and an aperture is formed through the front of the bound panels cutting a U-shaped portion from the face panel and a rectangular portion from the intermediate panel in a manner so that the face panel overlaps the aperture in the intermediate panel to form a pocket therein. The method of making this display mount provides for the die cutting of a single blank of material, such as paper board, scored with parallel lines to allow the folding of the boards into face-to-face relationship, and contact, cutting incisions into the intermediate or spacer panel of pre-determined shapes, case binding the front of the folded adjacent panels with a flexible lining material which is folded about the edges of the panels, and then die cutting in a generally U-shaped incision into the intermediate panel above the partial panel co-acting with the incisions already made in the intermediate panel, and then removing the bound together, severed portions of the face and intermediate panels simultaneously.

BRIEF DESCRIPTION OF THE DRAWINGS

Other objects, features, and advantages of the present invention will be apparent from the written description and the drawings, in which.

DESCRIPTION OF THE PREFERRED EMBODIMENT

Figure 1:
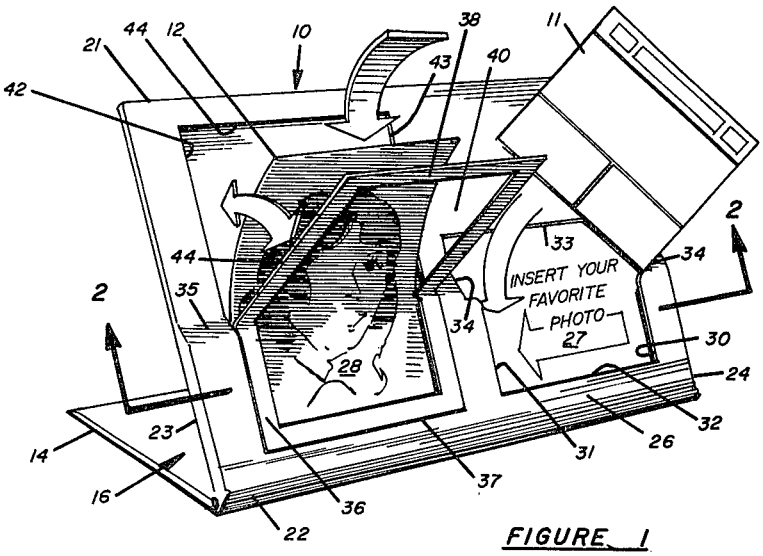
FIG. 1 is a perspective view of a preferred embodiment of a display mount in accordance with the present invention.
Figure 2:
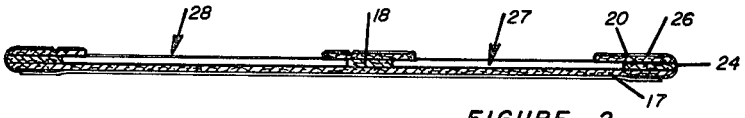
FIG. 2 is a sectional view taken on the line 2—2 of FIG. 1.
Figure 3:
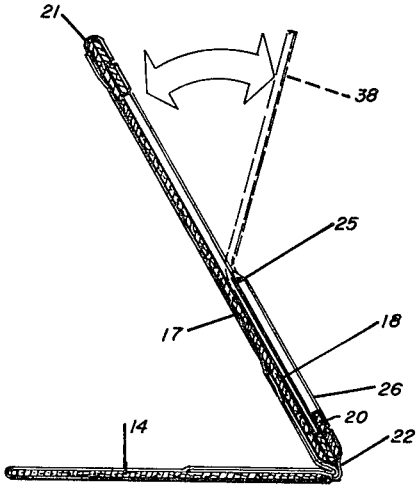
FIG. 3 is an end elevation of the display mount in accordance with FIGS. 1 and 2.

Referring to the drawings, and especially to FIGS. 1 through 3 of the drawings, a display mount 10 for a plural leaf calendar 11 and a photograph 12 is illustrated. The display mount 10 has a supporting base 14 and an aluminum hinge at bottom edge 22 as taught in my prior patents. The supporting base 14 is connected to the display mount indicated generally at 16, which may be, of course, supported in other manners than by the supporting base 14 without departing from the spirit and scope of the invention. The display mount portion 16 has a back panel or board 17, an intermediate or center spacing panel or board 18, and a partial face panel 20. The face panel 20 covers a portion of the face panels 17 and 18, which are generally about the same size and rectangularly shaped.

A display mount of this type will generally be made from a single blank of material, such as paper or cardboard, having a plurality of scored or intermittently cut lines running parallel to each other along the material at the hinge on folding points so that the three panels 17, 18, and 20 can be made from a single piece of material. The display portion 16 has the back panel 17 and intermediate panel 18 folded at the top edge 21 and the partial face panel 20 being folded at the bottom edge 22. The substantially parallel side edges 23 and 24 are aligned, while the face panel 20 has its top edge 25 extending partially above the base of the back and intermediate panels 17 and 18. The front mounting panels are case bound with a flexible facing material 26, which is adhesively secured over the partial face panel 20 over the edge 25 and over the top portion of the intermediate panel 18, and folded about the edges 21, 22, 23, and 24 to bind the panels together while providing a decorative facing to the display mount 10. A calendar well or aperture 27 and a photo well or aperture 28 are provided in the face of the display mount 16 with a calendar mount for calendar 11 having the partial panel 20 having parallel pocket sides 30 and 31, and a bottom side 32. Sides 30 and 31 overlap the cutout of the aperture 27 in the intermediate panel which intermediate panel cutout extends above the partial face panel 20 with a top side 33 and a pair of parallel sides 34. Thus, the calendar can be inserted in the pocket 27 under the edges 30 and 31 formed in the face panel 20, and abutting the edge 32 usually comprising the edges of panels 20 and 18. The use of the front panel covering only a portion of the other panels reduces the weight of the calendars to reduce the postage and mailing, but provides a slight slope 35 where the face panel comes to an edge. The edge is, however, covered with the binding material which extends over the exposed surface of 18 spacing board.

In the embodiment illustrated in FIGS. 1, 2, and 3, a photo mount pocket 28 has been cut out from the intermediate board 18, and a photo framing portion 36 has been formed into the face panel 20 by debossing lines 37, while the framing portion 38 has a cutout portion 40 and cut incisions in the intermediate panel 18 formed to continue the debossing lines 37 by the cuts at 42 and 43 and a to cut at 44. The photo 12 may be inserted into the aperture 28 adjacent the base panel 17 by lifting the frame portion 38, and sliding the photo under the side-pockets 36 and whereby photo portion 38 folds at the edge 35 of the face panel 20, and is held in place adjacent the parallel edges 42 and 43, and the top edge 44 by the frictional contact with the edges of frame portion 38.

Figure 5:
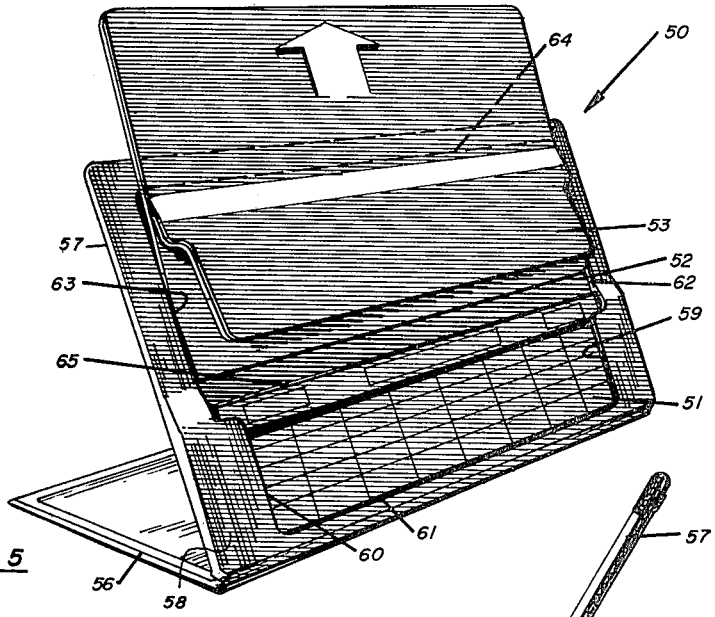
FIG. 5 is a perspective view of a second embodiment of a display mount in accordance with the present invention.
Figure 6:
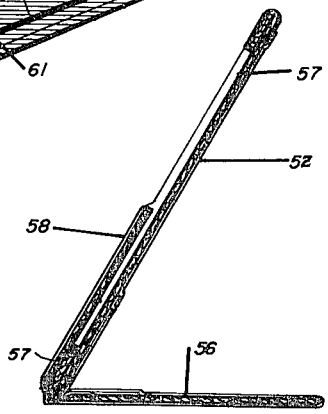
FIG. 6 is an end elevation of the embodiment of FIG. 5.

FIGS. 5 and 6 illustrate a display mount 50 for inserting a calendar 51 or the like into a pocket and which may have advertising copy printed on back panel 52 and also printed copy located under the calendar 51 on the same back panel 52. This embodiment has the support base 56 with the display mount 50 having a back panel 52, an intermediate panel 57, and a partial face panel 58, which are case bound with a flexible facing material folded about the edges and adhesively secured into position. The partial face panel 58 has the pocket edges 59 and 60 substantially parallel to each other, and the bottom edge 61 cut therein for forming the pocket which the intermediate panel 57 is cut with edges 62 and 63 wider than the pocket edges 59 and 60 to thereby form the pocket. The edges 63 and 62 may extend well above the face panel 58 to a top edge 64, which is well above the top edge 65 of the calendar 51, thereby allowing the copy material to be printed in a recessed area formed by the edges 62, 63, and 64, and on the back panel 52, which also allows printing to be made at the same time on the back panel beneath the calendar 51 in a single printing on a single layer. The use of the partial face panel 58, of course, has the same advantages and is arranged the same as described in connection with FIGS. 1 through 3.

Figure 4:
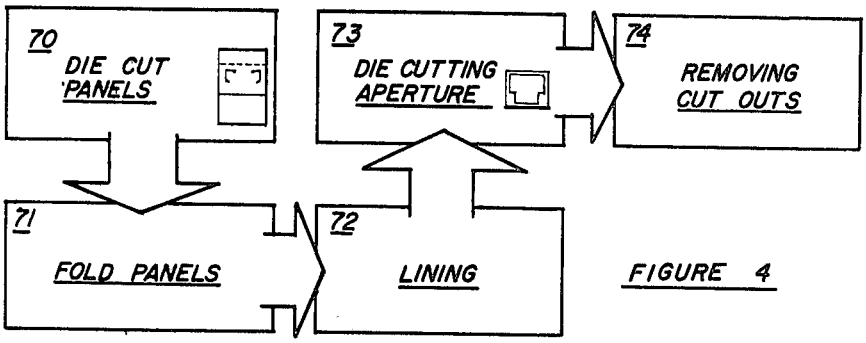
FIG. 4 is a block diagrom of the method of making the display mount in accordance with the present invention.

Turning to FIG. 4, the method of manufacturing a display mount in accordance with FIGS. 1 through 3, and FIGS. 5 and 6 is illustrated in a block diagram, in which block 70 is the cutting operation in which a single blank of material, such as paper board or cardboard is die cut into a pre-determined shape and a plurality or parallel lines is scored therein at the folding points to separate a rectangular back panel, a rectangular intermediate or spacing panel, and a partial face panel, and at the same time, incisions are cut into the intermediate panel shaped like a portion of the aperture for the pockets in the display mounts. This cut may be U-shaped, or may comprise two incisions shaped as shown with inwardly angled legs to form enlarged pocket edges on the completed display mount. The cut paper board is then folded in the step 71 at the scored (or intermittently cut) lines to from face-to-face planar surfaces, with the partial panel on the face of the three panels, then binding at 72 with a flexible lining material over the partial face panel and intermediate panel, and folded around edges of the three panels and adhesively secured thereto to provide a decorative cover as well as binding edges of all the panels together and the edges of the front board to the spacer board. The next step is die cutting, 73, a generally U-shaped aperture in the partial face panel extending to one edge thereof to from a U-cutout in the partial face panel, and at the same time, cutting a generally inverted U-shape into the intermediate panel simultaneously, which together co-act with the prior incisions made in the cutting step 70, so that an entire aperture has been cut into the intermediate panel using the backing panel as an anvil or support in the cutting, so that the cutout portion from the face panel and the cutout portion from the intermediate panel can be removed simultaneously since they are bound together by the binding, thereby leaving a mount having a pocket formed by the facing panel over the larger cutout in the intermediate panel with the cutout in the intermediate panel extending well above the location for the calendar 51 in the present embodiment. The bound together cutouts are shown in FIG. 5 having partial face cutout 53 bound to the cutout from the intermediate panel. Thus, the face panel 53 can have advertising copy printed thereon to provide a three dimensional effect to the calendar and advertising material. Additionally, advertising copy can be printed below the calendar 51 on the same plane. The prior step before printing is removing the cutouts (74) in a simultaneous removal of the bound together cutout portion of the face panel and the intermediate panel.

Cutout 75 has the removed portion of face panel 53 case mounted to the cutout panel 76 as shown in FIG. 5, while the face of the opposite side of output panel 76 is open paperboard. Conveniently, the removed portion 75 is hinged by the casebinding at 77 to resemble a support panel for the removal panel 76. A calendar pad can be attached to the opposite side of panel 76 covering the uncovered paperboard, thereby providing a calendar mount from the removed portion 75 having one side covered with a calendar and the other side case bound, which case binding forms the hinge for the severed portion of front panel 53. In addition, the side of the removed portion 75 shown in FIG. 5 can be printed at the same time as the display mount 50 to provide a second custom printed calendar for only a small additional cost to the purchaser.

It should be clear at this point that a display mount of reduced weight and a simplified method of making a display mount of reduced weight has been provided, but it should be clear that other advantages and variations are contemplated as being within the scope of the invention. Accordingly, the present invention is not to be construed as limited to the particular forms disclosed herein, which are to be regarded as illustrative rather than restrictive.

I claim:

1. A method of making a display mount comprising the steps of:

cutting a blank of planar material to form a back, an intermediate, and a partial face panel, and cutting at least one curved incision into the intermediate panel of three panels formed on said blank;

superimposing said panels to form face-to-face planar surfaces with said partial face panel extending over at least a portion of said cut incisions in said intermediate panel;

case binding the front of said superimposed panels with a flexible lining material extending about multiple edges and adhesively attaching said lining material thereto for binding said panels together;

simultaneously die cutting a generally U-shaped incision in said partial face panel extending to a line inside one edge thereof and cutting a generally inverted U-shape into said intermediate panel coacting with said incision already made in said intermediate panel; and removing the severed portions of said partial panel and said intermediate panel to form a display mount having an inserting passage between the overlapping edges of said face panel and said base panel.

2. The method in accordance with claim 1, in which the step of removing the severed portions of said partial panel and said intermediate panel includes removing the severed portions bound together by said flexible binding.

3. The method in accordance with claim 2, in which said step of cutting a blank of planar material and cutting at least one curved incision into the intermediate panel of said three panels includes cutting two incisions, each having a hook like shape whereby die cutting a generally U-shaped incision in said partial face panel will produce a bottom partially overlapping edge partially overlapping said intermediate cutout panel.

4. The method in accordance with claim 1, including the step of attaching a calendar to the removed severed portion of said intermediate panel to form a second display mount having the face panel severed portion as a support panel case bound to said severed portion of the intermediate panel.

5. The method in accordance with claim 4, including the step of printing on the case binding of said display mount prior to removing said die cut portion of said partial face panel and intermediate panel, said printing including printing on the case binding of said severed portion to provide a custom printed display mount from the severed portion.

* * * * *